United States Patent [19]

Iwasaki et al.

[11] Patent Number: 4,985,999

[45] Date of Patent: Jan. 22, 1991

[54] HAND-HELD CLIPPER FOR REMOVING ENTANGLED FIBERS FROM THE SURFACE OF FABRICS

[75] Inventors: Jyuzaemon Iwasaki, Nagahama; Hideharu Nakano, Oumihachiman; Masahiro Tsuno; Zenichi Nakamura, both of Hikone, all of Japan

[73] Assignee: Matsushita Electric Works, Ltd., Japan

[21] Appl. No.: 419,398

[22] Filed: Oct. 10, 1989

[30] Foreign Application Priority Data

Oct. 15, 1988 [JP] Japan ..... 63-259801
Oct. 15, 1988 [JP] Japan ..... 63-259802

[51] Int. Cl.[5] ..... B26B 19/14; B26B 19/12; B25F 3/00

[52] U.S. Cl. ..... 30/206; 30/43.6; 30/133

[58] Field of Search ..... 30/205, 206, 347, 349, 30/351, 43.6, 133; 15/344

[56] References Cited

U.S. PATENT DOCUMENTS

| | | | |
|---|---|---|---|
| 2,648,902 | 8/1953 | Petersen | 30/133 |
| 3,079,684 | 3/1963 | Hertzberg | 30/43.6 |
| 3,360,857 | 1/1968 | Fortenberry | 30/43.6 |
| 3,368,231 | 2/1968 | Krauos et al. | 15/344 |
| 3,611,566 | 10/1971 | Brennan . | |
| 3,900,949 | 8/1975 | Anzalone | 30/133 |
| 4,089,110 | 5/1978 | Rasco . | |
| 4,150,483 | 4/1979 | Kanazawa . | |
| 4,393,586 | 7/1983 | Hamashima et al. | 30/43.6 |
| 4,675,998 | 6/1987 | Thijsse | 30/34.2 |
| 4,788,769 | 12/1988 | Maruyama | 30/133 |
| 4,811,483 | 3/1989 | Bakker et al. | 30/43.6 |

FOREIGN PATENT DOCUMENTS

| | | | |
|---|---|---|---|
| 3105167 | 10/1986 | Japan | 30/206 |
| 731123 | 6/1955 | United Kingdom | 30/34.2 |
| 1073070 | 6/1967 | United Kingdom . | |

*Primary Examiner*—Douglas D. Watts
*Assistant Examiner*—Paul M. Heyrana, Sr.
*Attorney, Agent, or Firm*—Stevens, Davis, Miller & Mosher

[57] ABSTRACT

A hand-held clipper for removing entangled fibers from the surface of fabrics has a grip handle with a cutting head. The cutting head comprises a perforated shear foil and cutter blades rotating in shearing engagement with the interior face of the shear foil. The shear foil is curved into a generally semi-cylindrical configuration having a longitudinal axis and define first and second side faces on the opposite sides of a curved top portion. The cutter blade has a cutting edge extending along the longitudinal axis of the shear foil and is driven to rotate in one direction about a rotations axis, which is common to the longitudinal axis of the shear foil, so as to move along the curved shear foil continuously from the first side face toward the second side faces. The first side face thus located rearwardly of the top portion of shear foil with respect to the rotating direction of the cutter blades is configured to have perforations larger than in the second side face located forwardly of the top portion in the rotating direction such that the entangled fibers once entered through the perforations in the first side face and clipped by the cutter blades can be well prevented from flowing outwardly through the perforations in the second or opposite side face of the shear foil.

10 Claims, 19 Drawing Sheets

13

10
11
16
12
28
51
50
80
20
40

80
84
83
10
11
13
16
15
24
12
20
23
28
36
21
23
60
61
63
64
70
62
40
68
61
71
65
52
57
56
71
56
51
50
53

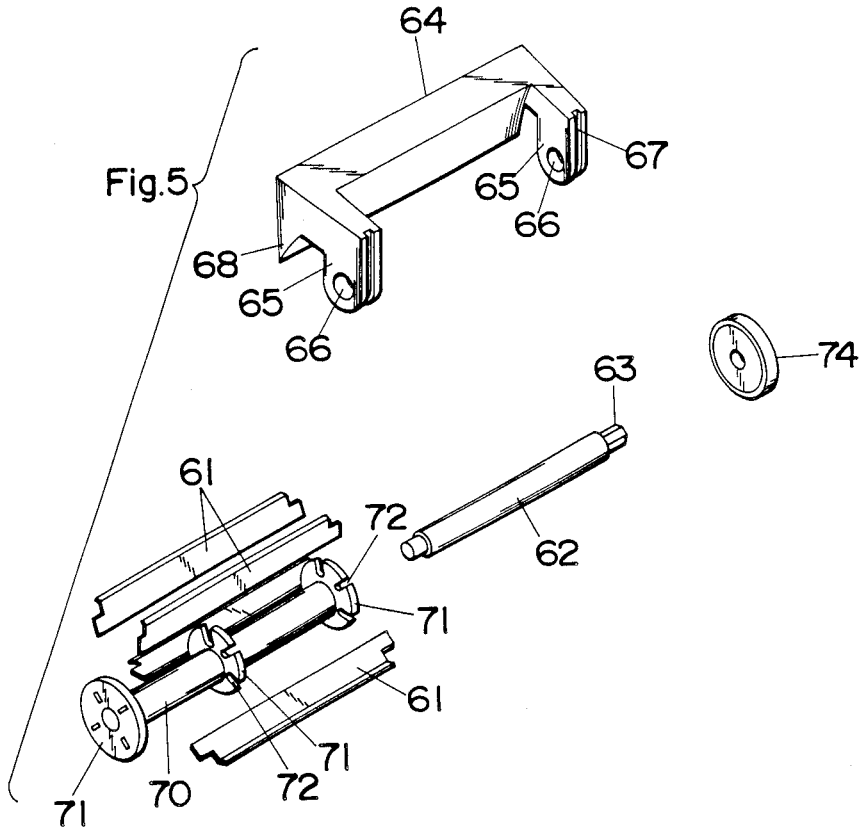
Fig.5
Fig.6A
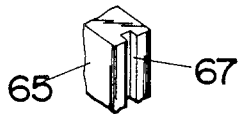
Fig.6B
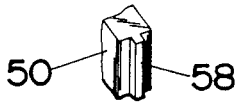

110
115
116
113
114
112
117
111
115
107
102
108
106
90
101
100
106

10A
11A
80A
12A
16A
20A
40A
51A
122
121
120

HAND-HELD CLIPPER FOR REMOVING ENTANGLED FIBERS FROM THE SURFACE OF FABRICS

BACKGROUND OF THE INVENTION

1. Field of the Invention

The present invention is directed to a hand-held clipper for removing entangled fibers from the surface of fabrics, and more particularly to such clipper having a semi-cylindrical shear foil and a rotary cutter rotating along the curved inner surface of the shear foil for clipping the entangled fibers entering perforation of the shear foil.

2. Description of the Prior art

There have been known hand-held clippers for removal of entangled strands of fibers or lints undesirably occurring on the surface of fabrics such as apparels and interior decorations. A prior art clipper is disclosed, for instance, in U.S. Pat. No. 4,788,769 to have a cutting head comprising a perforated circular shear foil and an inner cutter which sweeps in circumferential fashion around the inside of the shear foil. The circular cutting head with the rotary inner cutter, however, is found to be unsatisfactory since it may fail to achieve even cutting on an intended fabric surface due to an inherent difference in the rotating speed of an inner cutter blade between portions of the blade sweeping around the radially outward portion and the radially inward or center portion of the circular shear foil, and/or due to a difference in the number of perforations between the outward and inward portions of the shear foil. Further, the above cutting head is also found to be disadvantageous in that, when a greater working or cutting width is required, it has to be designed to have a correspondingly greater surface area or diameter, which makes the cutting head unduly bulky and inconvenient for handling.

One settlement for the above problems is to utilize a cutting head of reciprocating type. However, in the reciprocating type cutting head, a reciprocating inner blade is only allowed to move within a limited stroke along the inner surface of a conformably shaped shear plate, and is therefore not expected to forcibly draw in the lints through perforations of the shear plate enough to successfully shear the lints, resulting in poor cutting performance. In view of the above, it is found desirable to utilize a cutting head of a type having a semi-cylindrical shear foil and a rotary inner cutter rotating about a common longitudinal axis in sliding contact with the inside surface of the shear foil. The cutting head of this type provides a relatively wide working or cutting width without increasing overall surface area of the cutting head and enables the inner cutter to draw in the lints forcibly through perforations of the shear foil, and therefore satisfactory for clipping the lints or entangled strands of fibers from the fabric surface. Nevertheless, another problem is encountered in using the cutting head of this type. That is, when the semi-cylindrical shear foil has perforations of substantially the same sizes both in the opposed side faces thereof, the lints once entered through the perforations of one side face and clipped may be easily caused to flow to escape outwardly through the perforations in the other side face, failing to collect the clipped lints and leading to the scattering the lints over the finished fabric surface. Such undesirable scattering of the clipped lints is very likely since the clipper for the lint removing purpose is required to have the perforations which are relatively large sufficient to entrap the lints.

SUMMARY OF THE INVENTION The above problems and insufficiencies have been eliminated in the present invention which provides a hand-held clipper with a uniquely configured cutting head. The clipper of the present invention comprises a grip handle with the cutting head for removing entangled fibers or lints from the surface of fabrics. The cutting head comprises a shear foil having a number of perforations and a rotary cutter assembly having at least one blade in shearing contact with the inner surface of said shear foil. The shear foil is curved into a generally semi-cylindrical configuration centered on a longitudinal axis and defining a top portion and first and second side faces on opposite sides of the top portion. The rotary cutter assembly has a rotation axis which is common to the longitudinal axis of the shear foil. The cutter blade has an elongated cutting edge extending in parallel to the rotation axis and is driven to rotate in a cylindrical path about the axis in one direction to move from the first side face to the second side face in continuous shearing engagement therewith for shearing the entangled strands of fibers or lints entering the perforations in the shear foil. The shear foil is characterized to have the perforations larger at the first side face than at the second side face and also at the top portion. Accordingly, the cutting head can be manipulated in such a manner as to selectively bring the first and second side faces in facing relation to the fabric surface depending upon the size of the entangled strands of fibers or lints for effective removal of the lints therefrom. In addition, since the inner blade rotates in the direction from the first to the second side faces about the common axis, the lints once entered through the perforations and engaged with the cutter blade can be drawn forcibly in that direction and can be successfully clipped by the cooperation of the cutter blade and the perforations, after which the clipped lints caused to flow in that direction within the cutting head. Thus, the lints of relatively large size once entered and clipped through the larger perforations in the first side face can be prevented from flowing outwardly through the smaller perforations in the opposite second side face of the shear foil.

It is therefore a primary object of the present invention to provide a hand-held clipper which is capable of effectively clipping lints on the fabric surface and preventing the clipped lints from flowing outwardly back through the perforations to successfully recover the same within the clipper.

In a preferred embodiment, the perforations in the top portion of the shear foil are made smaller than those in the second portion such that the shear foil has the perforations of smallest size at the top portion which is normally kept in direct contact with the fabric surface during the manipulation of moving the cutting head across the fabric surface. This means that the larger perforations in the first and second side faces are less likely to come into direct contact with the fabric surface and therefore the fabric surface is prevented from being scratched by the larger perforations, thereby keeping the fabric surface substantially safe from harm.

It is therefore another object of the present invention to provide a hand-held clipper which is capable of preventing the fabric surface from being undesirably scratched at the top portion of the cutting head, yet assuring effective clipping operation at the first and second side faces of the cutting head.

The perforations are distributed over the shear foil in such a relationship that the perforations of substantially the same size are arranged in sloping zig-zag rows each forming an angle with the longitudinal axis of the shear foil and therefore with the cutting edge of the cutter blade. With this arrangement, the cutter blade can have less chance to slice a number of lints at one time and therefore can have reduced resistive load, giving rise to a smooth clipping operation by the cutter blade, which is therefore a further object of the present invention.

The clipper also includes a fan and recovery chute disposed adjacent the cutting head to collect the clipped lints. The fan produces an air flow which draws in outside air through the perforations of the shear foil and flows through a feed port into the recovery chute carrying the clipped lints in that air flow for feeding them into the recovery chute. The feed port is located in a position horizontally offset from a center plane normal to the top portion of the shear plate toward the second side face so that the clipped lints which flow in the rotating direction of the cutter blades can be successfully collected in the recovery chute.

It is therefore a still further object of the present invention to provide a hand-held clipper in which the clipped lints can be directed efficiently into a recovery chute.

The chute is detachably held on a mount base formed at one end of the grip handle. It is within the mount base that the above feed port is formed for intercommunication between the cutting head and the chute. The mount base is formed with an inclined deflector which extends into the chute in an overlying relation to the feed port. The inclined deflector acts to guide the air flow carrying the clipped lints into the chute and also acts as a guard for prohibiting access of the finger of the user through the feed port into the cutter blade when the chute is detached.

It is therefore a still further object of the present invention to provide a hand-held clipper in which the clipped lints can be efficiently transferred from the cutting head into the recovery chute and at the same time the cutter blade is safely guarded from accidental access by the finger of the user when the chute is detached.

In addition, the present invention discloses a further advantageous feature in that the cutting head can be replaced by a cleaning head for cleaning the fabric surface. The handle grip incorporates a drive motor and has a drive coupling for driving connection with the cutting head or the cleaning head selected. The cutter blade is held on a center shaft which defines the rotation axis and is detachably coupled at its one end to the drive coupling when the cutter assembly is attached so that it is driven by the motor to rotate for effecting the clipping operation. The cleaning head comprises a hood detachable to the mount base and a brush rotating in the hood. The brush includes a number of bristles arranged along and supported by a like center shaft which is also detachably connected at its one end to the drive coupling when the cleaning head is attached to the mount base so that the brush is driven to rotate by the motor within the hood. The hood is provided with a plurality of longitudinally spaced and transversely extending slits through which the ends of the bristles extend outwardly for brushing away dust on the fabric surface as the cleaning head is manipulated across the fabric surface. The dust can be drawn in through the slits by the rotating brush and carried on the air flow by the fan into the common recovery chute.

These and still other objects and advantages will become more apparent from the following description of the preferred embodiment when taken in conjunction with the attached drawings.

BRIEF DESCRIPTION OF THE DRAWINGS

FIG. 5 is an exploded perspective view of an inner cutter assembly of the clipper;

FIGS. 6A and 6B are partial views respectively showing portions of the inner cutter assembly;

DETAILED DESCRIPTION OF THE PREFERRED EMBODIMENT

Figure 1:
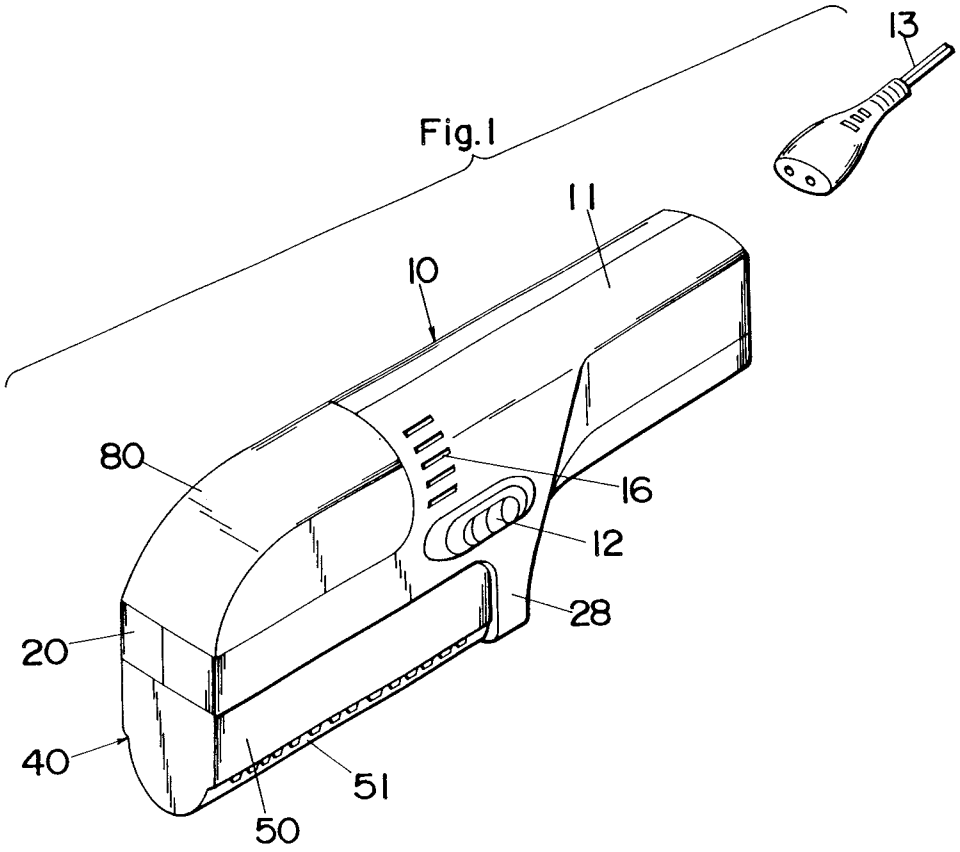
FIG. 1 is a perspective view of a hand-held clipper in accordance with a preferred embodiment of the present invention.
Figure 2:
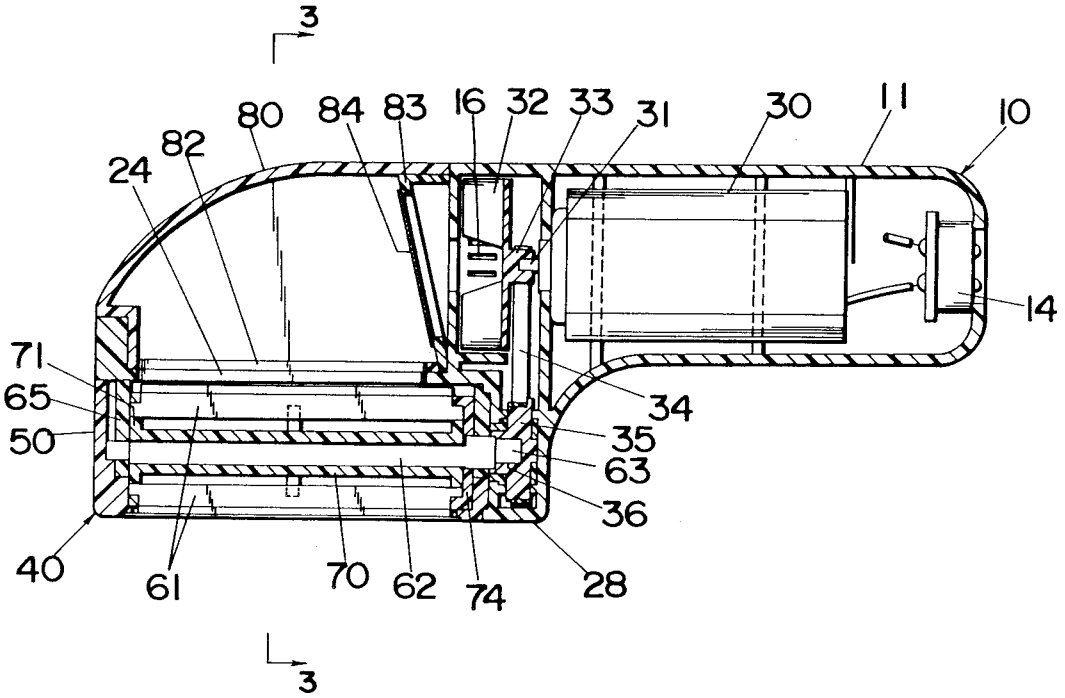
FIG. 2 is a vertical sectional view of the clipper.
Figure 4:
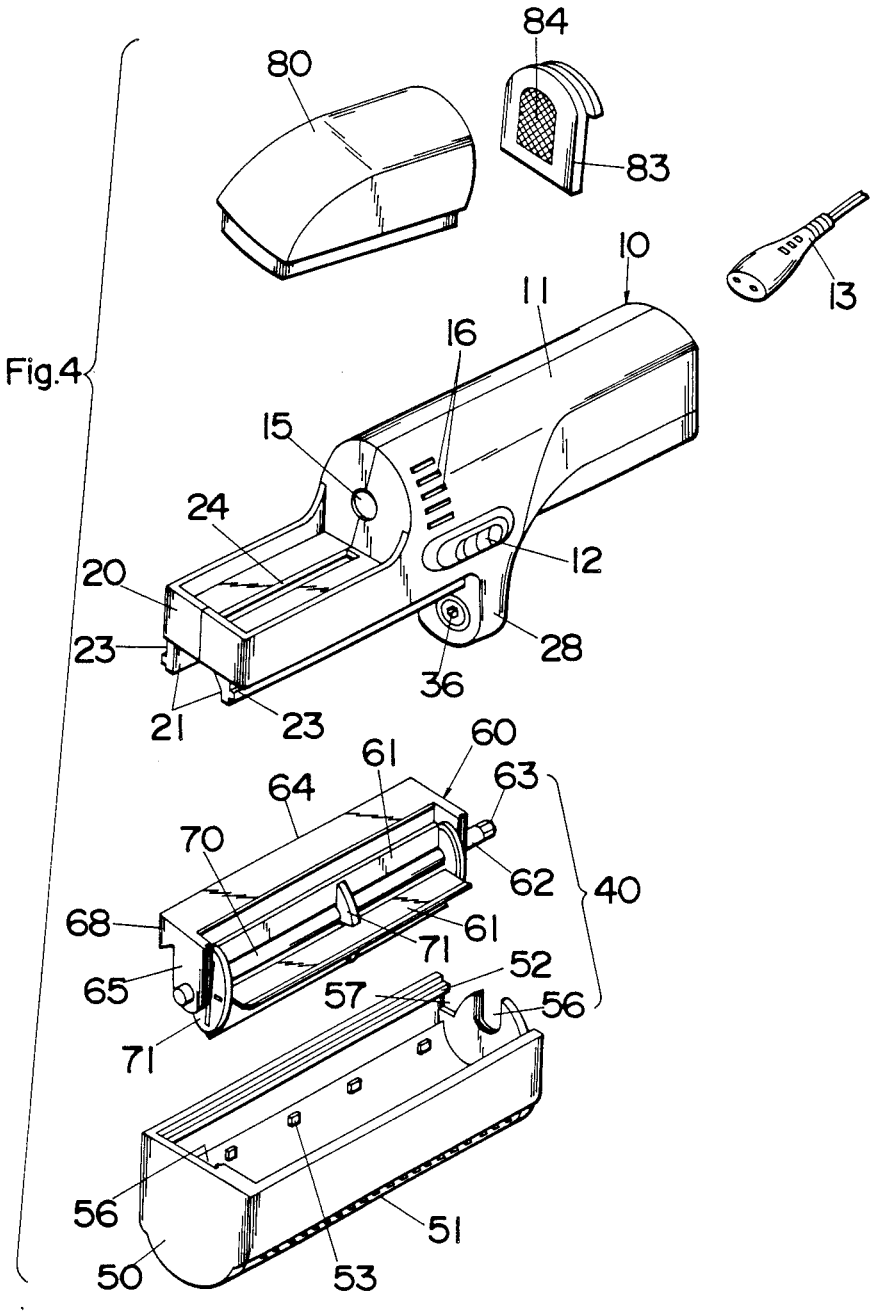
FIG. 4 is an exploded perspective view of the clipper.

FIG. 1 illustrates a hand-held clipper for removing entangled strands of fibers or lints from a fabric surface in accordance with a preferred embodiment of the present invention. The clipper comprises an elongated housing 10 formed at its one end with a grip 11 and at the other end with a mount base 20 detachably receiving a cutting head 40 and a recovery chute 80. As shown in FIG. 4, the cutting head 40 comprises a frame 50 supporting a perforated shear foil 51 and an inner cutter assembly 60 having a plurality of cutter blades 61 supported on a Center shaft 62. Disposed within the grip 11 is an electric motor 30 which drives the cutter blades 61 to rotate within the frame 50 for clipping the lints entering perforations of the shear foil 51. The motor 30 is turned on by a switch handle 12 on the grip 11 and is electrically connected to a commercial voltage source by way of a power cord 13 detachably to a terminal socket 14 at the rear end of the housing 10. The motor 30 may be alternately energized by a battery incorporated in the housing 10. A fan 32 is incorporated to produce an air flow for collecting the clipped lints into the recover chute 80, the detail of which will be discussed later.

Figure 3:
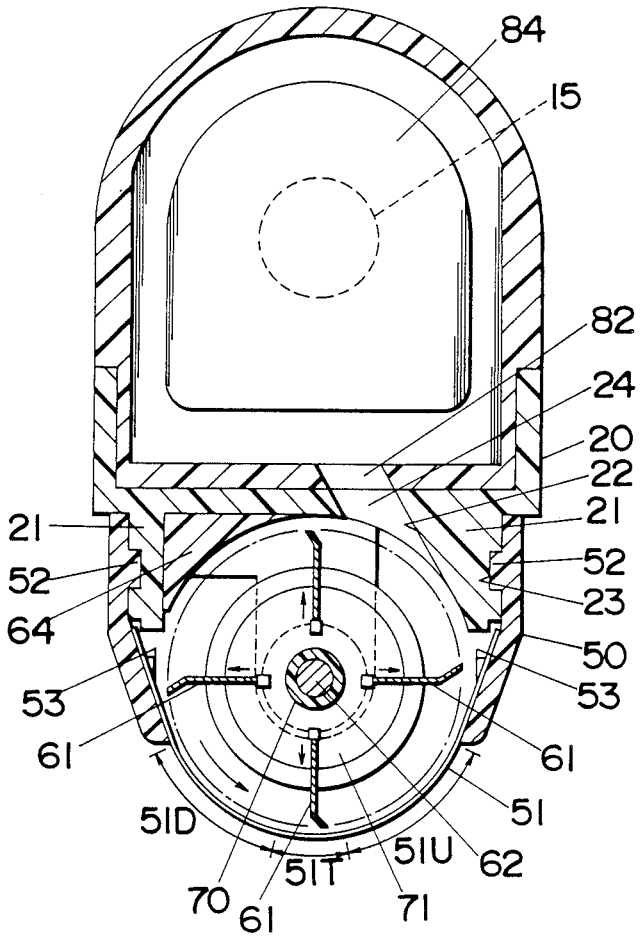
FIG. 3 is a sectional view taken along line 3—3 of FIG. 2.

The cutting head 40 is detachably supported to the mount base 20 by the frame 50. As best seen in FIGS. 3 and 4, the frame 50 is formed on the interior of opposed side walls with longitudinally extending ribs 52 which slidably engage into corresponding grooves 23 in the mount base 20. Thus, the cutting head 40 is attached to and removed from the mount base 20 by being slid along the lengthwise direction of the mount base 20. The grooves 23 are formed respectively in the outer surfaces of flanges 21 projecting on the bottom of the mount base 20 in transversely spaced relation to one another. As shown in FIG. 3, the shear foil 51 extends in a semi-cylindrically curved fashion between the opposed side wall of the frame 50 and supported thereto with latch projections 53 on the interior of the side walls engaged into corresponding retention holes 54.

As shown in FIGS. 4 and 5, the inner cutter assembly 60 includes an elongated bracket 64 having a pair of end plates 65 between which the cutter blades 61 are supported on the center shaft 62. The center shaft 62 extends through a sleeve 70 and rotatively fixed therewith. The sleeve 70 has axially spaced holder disks 71 which supports the cutter blades 61 in equally spaced relation around the center shaft 62. Each of the cutter blade 61 has a cutting edge extending in parallel with the center shaft and is received in radially extending slits 72 in the holder disks 71 so that, as the center shaft 61 rotates, the blade 61 is urged radially outwardly by a resulting centrifugal force for positive engagement with the inner face of the shear foil 51. The sleeve 70 carrying the cutter blades 61 is assembled to the bracket 64 with the ends of the center shaft 62 journaled in bearing holes 66 formed in the end plates 65. The one end of the center shaft 62 extends through the corresponding end plate 65 to define thereat a coupling end 63 for detachable driving connection to the motor 30. A cap 74 is fitted over the holder disk 71 adjacent the coupling end 63 for retaining the ends of the cutter blade 61 on the sleeve 70. Replacement of the cutter blades 61 can be easily made by removing the cap 74. The inner cutter assembly 60 thus formed is received within the frame 50 in a predetermined relation thereto such that the center shaft 62 has its rotation axis in coincidence with a longitudinal axis of the shear foil 51, as shown in FIG. 3. In this condition, the end plates 65 of the bracket 64 engage into top-open notches 56 formed respectively in the opposed ends of the frame 50, and at the same time the bracket 64 is engaged at its lateral end 68 into a recess 57 adjacent the notch 56. As best seen in FIGS. 6A and 6B, each of the end plates 65 is formed in its periphery with a groove 67 into which engages a corresponding ridges 58 formed on the periphery of each notch 56 for preventing undesirable axial shifting of the cutter assembly 60 within the frame 50. As shown in FIG. 3, the bracket 64 has its interior surface curved along the circular path of the cutter blades 61. The exterior of the bracket 64 is so configured as to fit inside of the flange 21 projecting downwardly from the mount base 20 for exact positioning of the cutter assembly 60 within the frame 50 and in relation to the mount base 20.

Projecting downwardly from the mid portion of the housing 10 is a jaw 28 which closes the rear end of the cutting head 40. The jaw 28 is provided with a drive socket 36 into which the coupling end 63 of the center shaft 62 is detachably engaged for establishing a driving connection from the motor 30 to the center shaft 62. Thereby, the cutter blades 61 are driven to rotate in one direction, i.e., in the counterclockwise direction in FIG. 3. The drive socket 36 is formed in the center of a pulley 35 rotatively supported within the jaw 28 and coupled by a belt 34 to a spindle 33 into which the output shaft 31 of the motor 30 engages. The spindle 33 is formed integrally on the rear end of the fan 32 so that the fan 32 is simultaneously driven to rotate for producing an air flow collecting the clipped lints into the chute 80.

Figure 7:
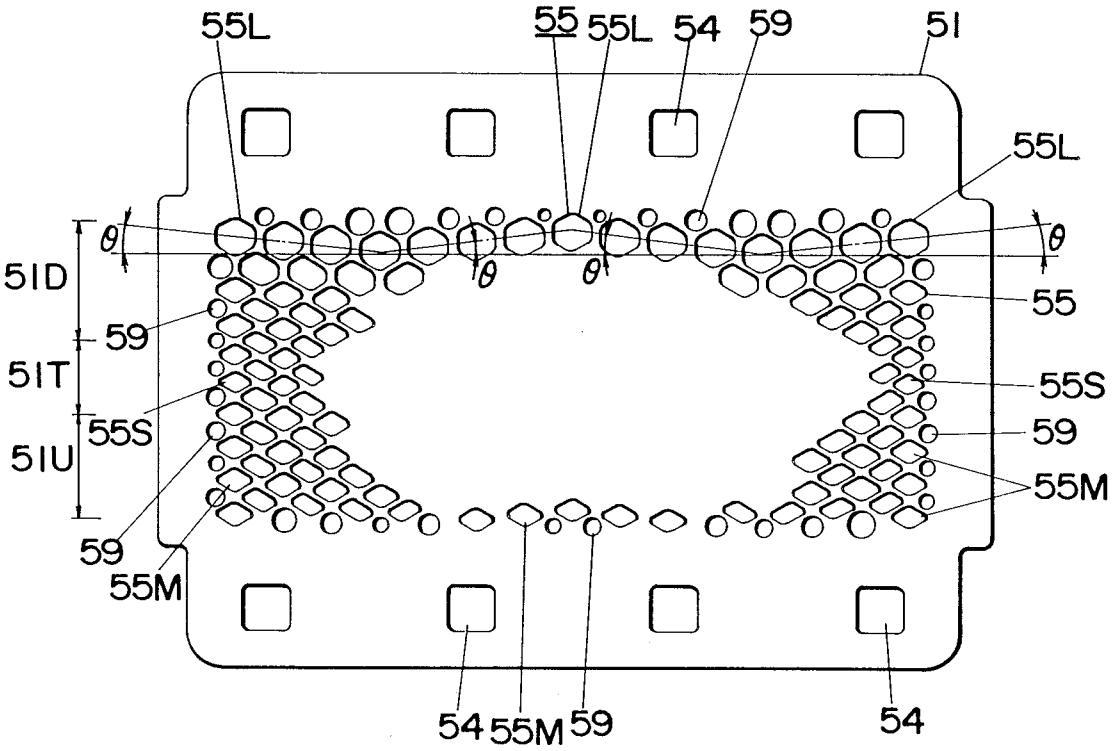
FIG. 7 is a top plan view of a shear foil in a non-curved condition shown with perforations in the center portion omitted.

The shear foil 51 has a number of perforations 55 of different sizes arranged in a particular order over the effective surface of the shear foil 51, as shown in FIG. 7 (although the perforations in the center portion of the shear plate are omitted). The perforations 55 are generally classified into three types depending upon their sizes, i.e., perforations 55L of large sizes, perforations 55M of medium sizes, and perforations 55S of small sizes. The large perforations 55L are distributed in a portion which defines one side face (down-cut side) 51D of the semi-cylindrically curved shear foil 51 located rearwardly of the top end portion 51T with respect to the rotating direction of the cutter blades 61, while the medium perforations 55M are distributed in a portion which defines the opposite side face (up-cut side) 51U of the shear foil 51 located forwardly of the top end portion 51T with respect to the rotating direction of the cutter blades 61. The small perforations 55S are distributed in the top portion 51T of the shear foil 51. Further, the perforations 55L, 55M, 55S are arranged along sloping zig-zag rows each forming an angle $\ominus$ of about 10° with the longitudinal axis of the shear foil 51. Such relation is particularly advantageous for the large perforations 55L by the reason as discussed later. As seen in the figure, the large perforations 55L are preferably to be made gradually smaller toward the top portion of the shear foil 51T than at the end. The shear foil 51 has additional round holes 59 which are distributed around an effective cutting zone including the perforations 55L, 55M, and 55S in order to facilitate to curve the shear foil 51 into the desired configuration.

Figure 8:
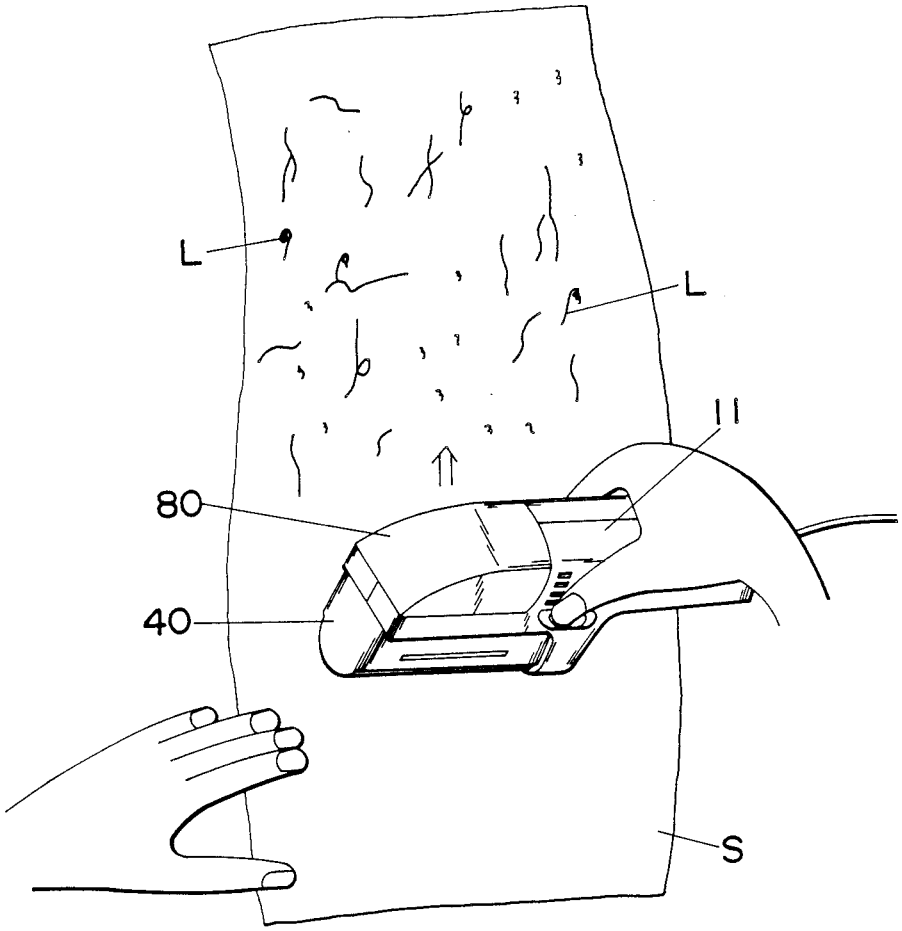
FIG. 8 is a perspective view illustrating a manner of using the clipper for removing lints from a fabric surface.
Figure 9:
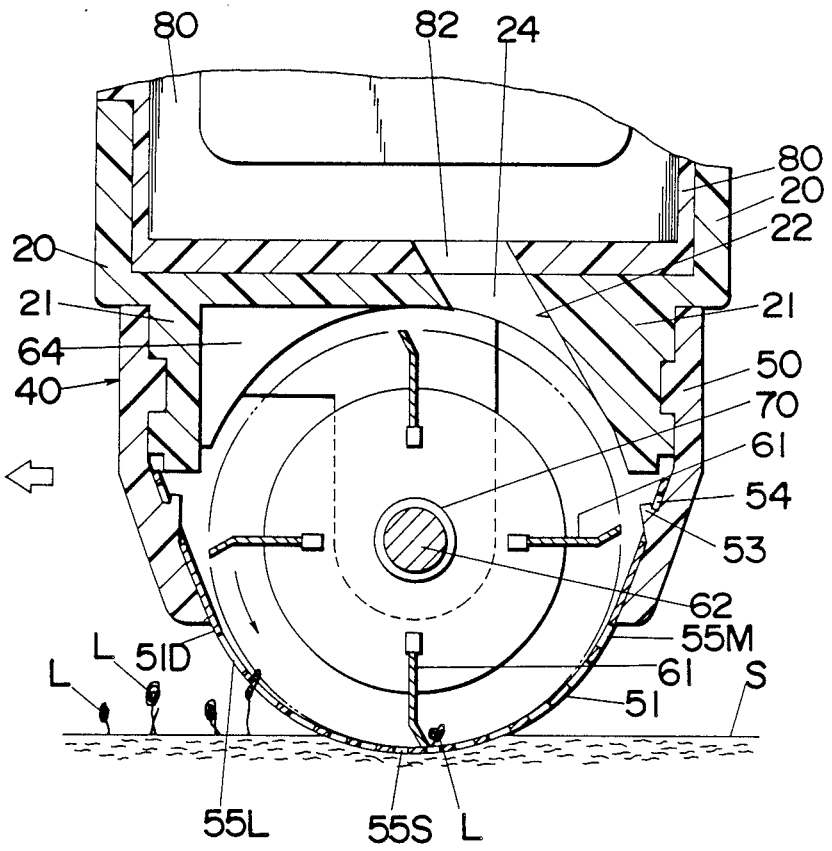
FIGS. 9 and 10 are sectional views illustrating manners of using the clipper for removing relatively large and small lints, respectively.
Figure 10:
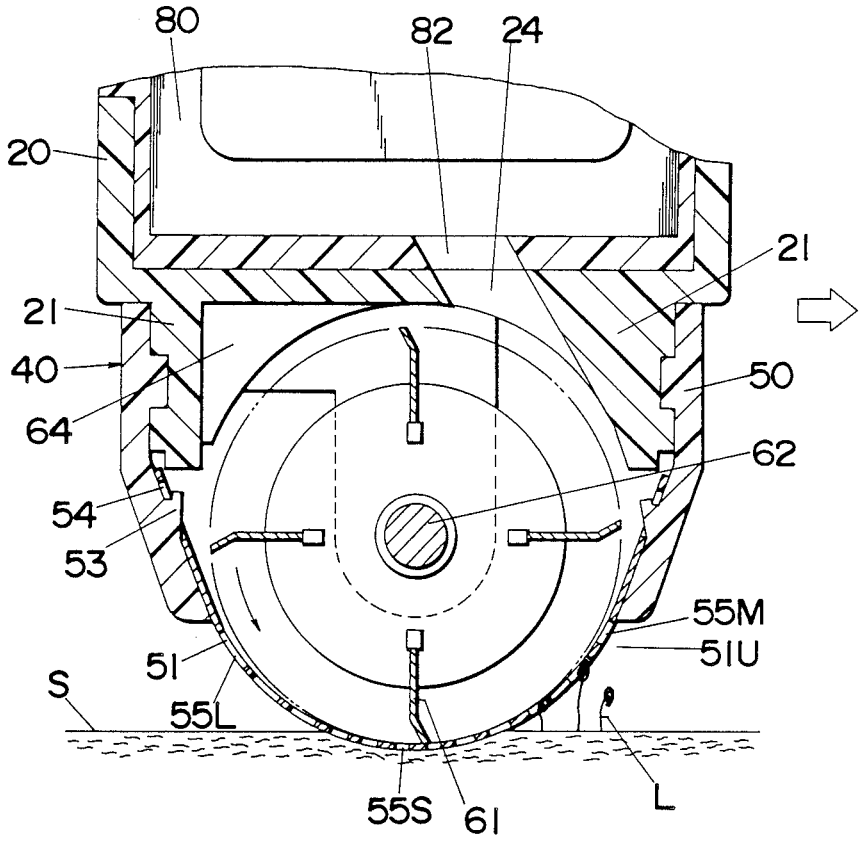
Figure 11:
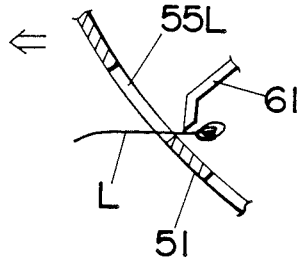
FIG. 11 is an enlarged partial view of a portion of FIG. 9.

In operation, the clipper is manipulated to move the cutting head across the fabric surface S in a direction generally perpendicular to the longitudinal axis of the cutting head 40, as shown in FIG. 8, to remove lints L on the surface S. When moving the cutting head 40 in the direction with the down-cut side 51D facing forward, as shown in FIG. 9, relatively large and tall lints L will enter the large perforations 55L and be cut by the cooperation of the cutter blades 61, during which the rotating cutter blades 61 act to forcibly draw the lints L entering the perforations 55L in the rotating direction, as shown in FIG. 11, to thereby assure successful clipping of the lints L from the fabric surface S. When moving the cutting head 40 in the direction with the up-cut side 51U facing forward, as shown in FIG. 10, medium sized lints L will be caught by the corresponding perforations 55M in the up-cut side 51U of the shear foil 51 and cut by the rotating cutter blades 61. In either case, the small perforations 55S in the top portion of the shear foil 51 act to cut relatively small and tiny lints L from the fabric surface S. Thus, the lints of differing sizes can be successfully clipped by selectively moving the cutting head 40 in the directions with the down-cut side and up-cut side of the shear foil 51 facing forward. During the above clipping operations, the cutting head 40 is normally manipulated to have only the top portion 51T of the shear foil 51 in direct contact with the fabric surface S so that the small perforations 55S will act to clip only the tiny lints and not to substantially damage or harshen the fabric surface. It should be noted at this point that, since the perforations, particularly the large ones 55L are arranged on the zig-zag sloping rows as discussed with reference to FIG. 7, each cutter blade 61 will have less chance to simultaneously engage a large number of lints and therefore can have a reduced resistive load, ensuring a smooth clipping operation. Further, because of the cutter blades 61 are radially movable and urged by the centrifugal force into contact with the inside face of the shear foil 51, even when the cutter blade 61 becomes entangled heavily with the lints, it is permitted to retard radially inwardly so as to be disengaged therefrom, thereby preventing accidental stopping of the cutter blade and assuring continued clipping operation. The cutter blades 61 may be alternately urged radially outwardly by means of additional springs or by inherent resiliency given to the inner blades.

The clipped lints are then carried on the air flow produced by the fan 32 into the recovery chute 80 through a feed port 24 formed in the mount base 20. The feed port 24 extends longitudinally of the mount base 20 to cover the length of the cutter blades 61 and, as best shown in FIG. 3, it is offset laterally from the center of the mount base 20 toward the up-cut side of the shear foil 51 so that the clipped lints can be directed through the feed port 24 into the chute 80 as the cutter blades 61 rotates. For effectively guiding the clipped lints through the feed port 24, one of the flanges 21 has its inner surface 22 inclined contiguous with the edge of the feed port 24. The chute 80 has in its bottom collection port 82 in registration with the feed port 24 and has its rear end closed by an end plate 83 with a filtered port 84. The filtered port 84 communicates with an intake port 15 formed in the front face of the grip 11 forwardly of the fan 32. Exhaust ports 16 are formed in the side wall of the front end of the grip 11 in such a manner to surround the fan 32 to escape the air flow outwardly of the grip 11. As previously stated, the fan 32 is driven to rotate simultaneously with the clipping operation of the cutting head 40 to produce the air flow by drawing the outside air through the perforations of the shear foil 51, the feed port 24, the collection port 82, filtered port 84, the intake port 15, and directed outwardly through the exhaust port 16. Thus, the clipped lints are carried by the air flow into the chute 80 and retained therein as the air flow passes the filtered port 84. It is noted, in this connection, that since the shear foil 51 has the larger perforations 55L only at the first side face and has smaller perforations 55M and 55S at the other portions, the perforated area of the entire shear foil can be reduced as compared to the case when the larger perforations are distributed over the entire shear foil so that the air flow developed by the fan 32 can be made stronger for effectively collecting the clipped lints into the chute 80.

Figure 12:
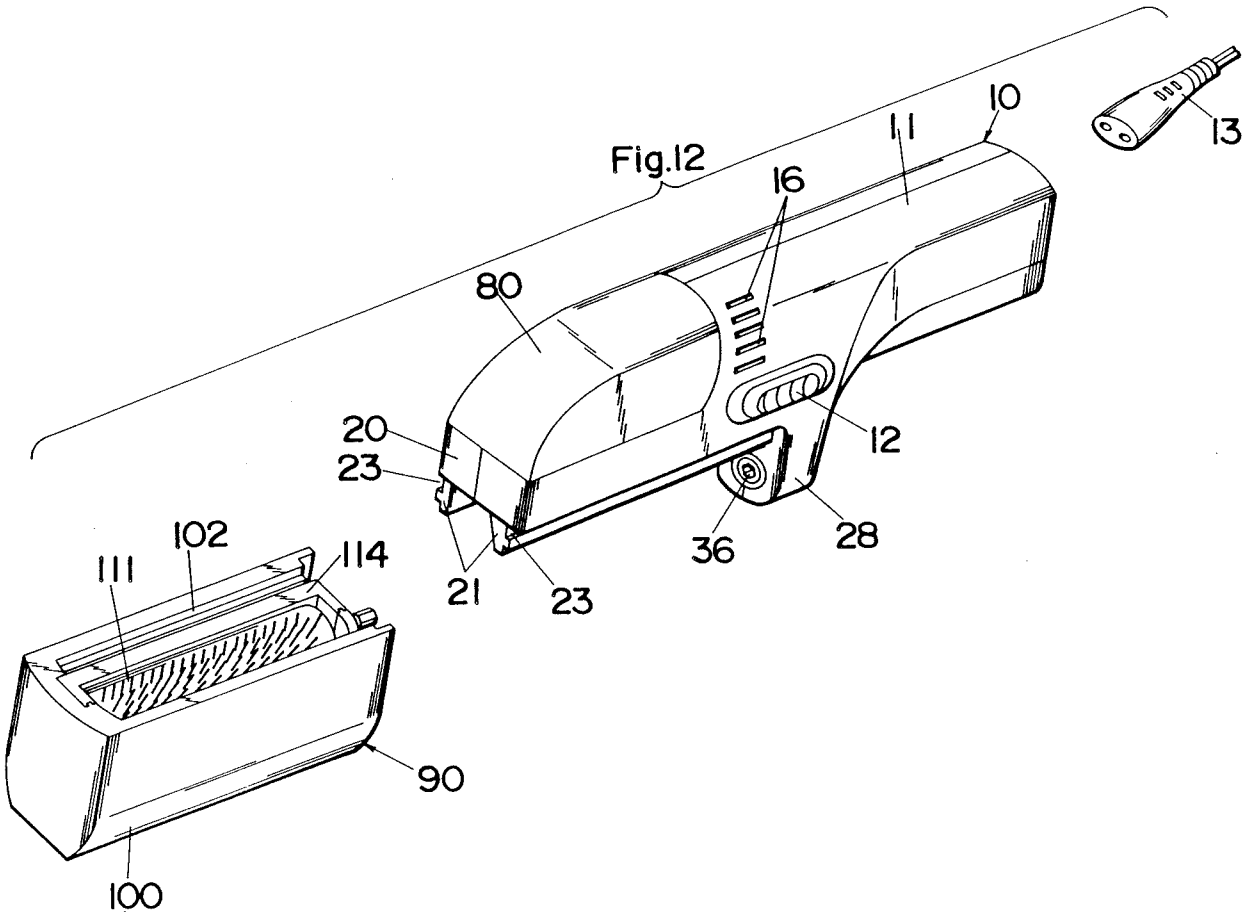
FIG. 12 is an exploded perspective view of the clipper of which cutting head is replaced by a cleaning head.
Figure 13:
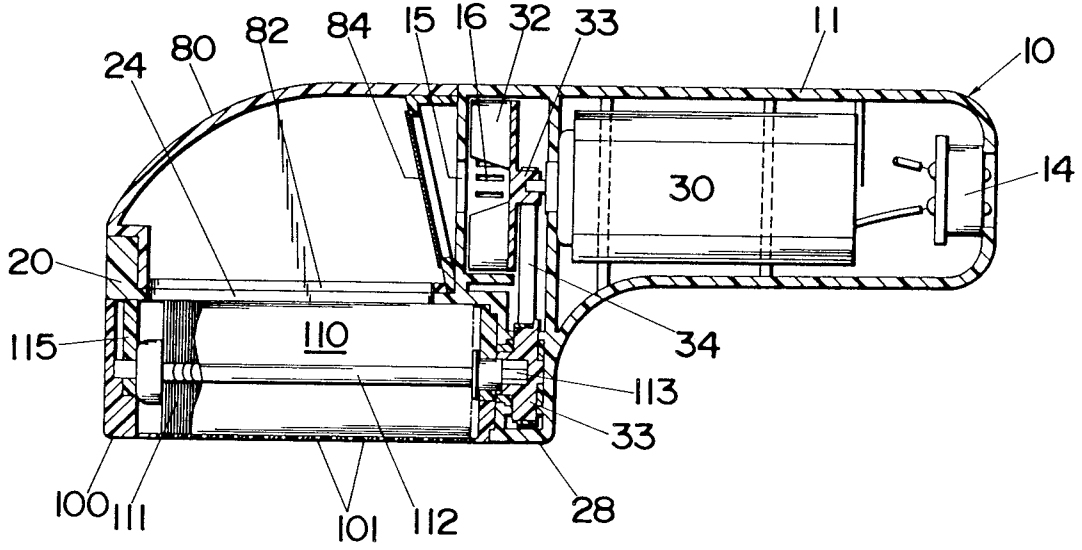
FIG. 13 is a vertical sectional view of the clipper of FIG. 12.
Figure 14:
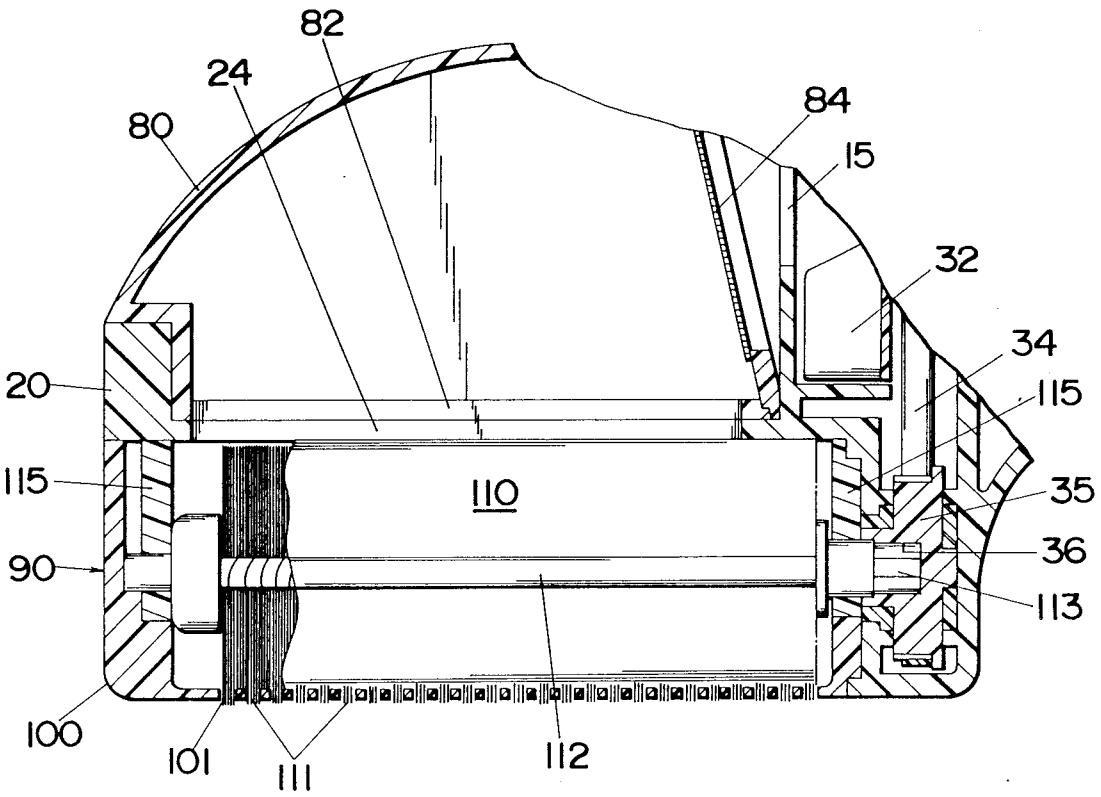
FIG. 14 in an enlarged sectional view of the cleaning head in an attached condition to a grip handle of the clipper.
Figure 15:
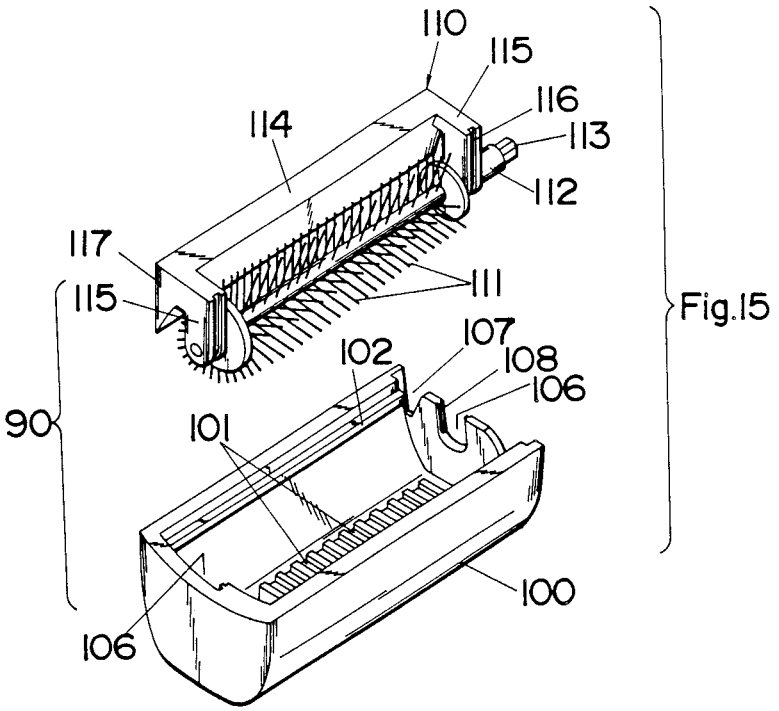
FIG. 15 is an exploded perspective view of the cleaning head.
Figure 16:
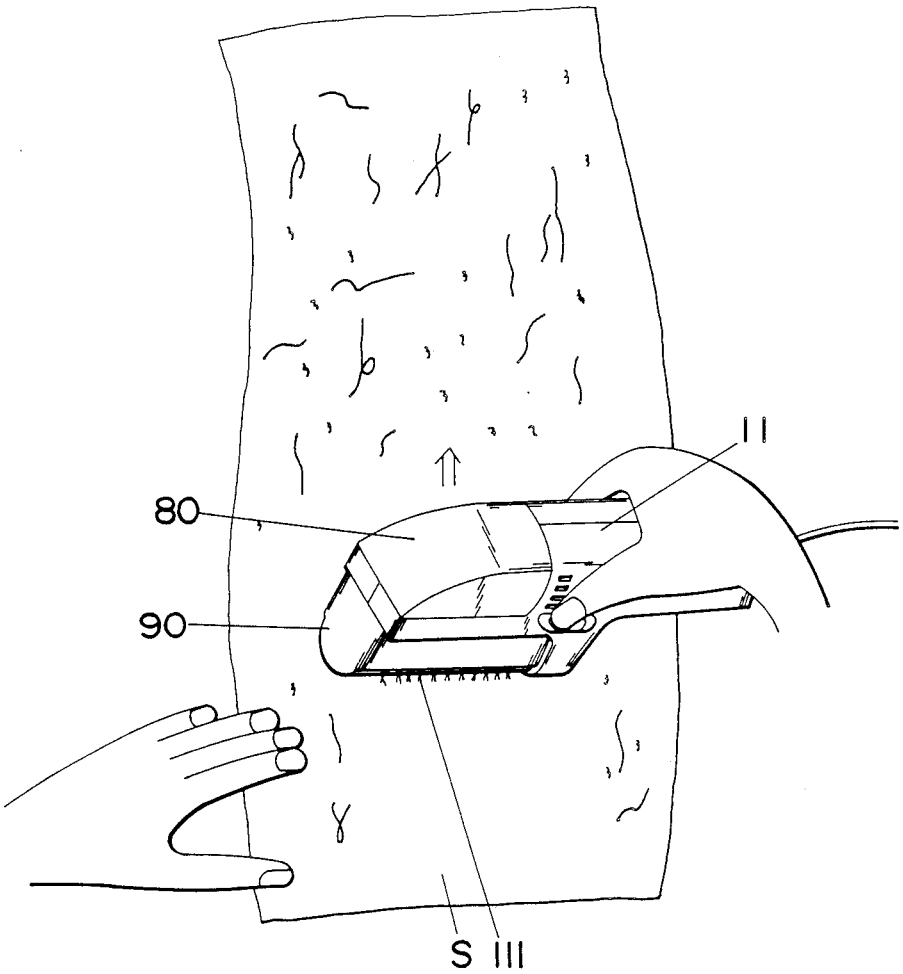
FIG. 16 is a perspective view illustrating a manner of using the cleaning head for collecting dust from a fabric surface.

FIG. 12 illustrates a cleaning head 90 which may be attached to the mount base 20 in place of the above cutting head 40 for removing dusts from the fabric surface and collecting the same into the common chute 80. The cleaning head 90 is designed to have substantially the same exterior configuration to the cutter assembly 40 and comprises a cover frame 100 and a brush assembly 110. The cover frame 100 has a pair of ribs 102 on the upper inner ends thereof and is detachably supported to the mount base 20, in the like manner as the cutting head 40, by sliding engagement of the ribs 102 with the grooves 23 in the mount base 20. The bottom of the cover frame 100 has a plurality of parallel slits 101 which extend transversely and are spaced in the lengthwise direction of the cover frame 100. As shown in FIG. 15, the brush assembly 110 includes a center drive shaft 112 carrying a number of bristles 111 arranged circumferentially and along the drive shaft 112. The drive shaft 112 is supported by a like bracket 114 which is in turn supported to the cover frame 100 with end plates 115 of the bracket 114 received in corresponding notches 106 formed respectively in the end walls of the cover frame 100. For exact positioning of the brush assembly 110 within the cover frame 100, the bracket 114 has its laterally projecting portion 117 engaged in a recess 107 adjacent the notch 106, while a ridge 108 on the periphery of each notch 106 engages into a corresponding groove 116 formed in each of the end plates 115. One end of the center drive shaft 112 extends outwardly to define thereat a coupling end 113 which is detachably inserted into the drive socket 36. The brush assembly 110 is coupled to the cover frame 100 such that, as shown in FIG. 14, the ends of the bristles 111 project through the individual slits 101. Thus, by moving the cutting head on the fabric surface in the direction parallel to the slits 101, as shown in FIG. 16, the dust or the lints remaining on the fabric surface S can be brushed away by the bristles 111 driven by the motor 30 to rotate in one direction, and be then collected into the recovery chute 80 as carried by the air flow produced by the fan 32. In this manner, the hand-held lint removing clipper of the present invention can be readily transformed to a cleaning device simply by replacing the cutting head 40 by the cleaning head 90 so that the clipped lints and the dust remaining on the fabric surface can be successfully collected in the common chute 80 in the above cleaning operation subsequent to the clipping operation. With the provision of projecting the ends of the brush through the slits 101 in the bottom of the cover frame 100, the brush can be prevented from dragging in the fabric and therefore from harming the same. Further, because of that the cover frame 100 is open only at the slits 101 to have a reduced opening area, the air flow produced by the fan 32 can be made sufficiently strong to draw in the dust or the clipped lints without leaving the dust on the fabric surface.

Figure 17:
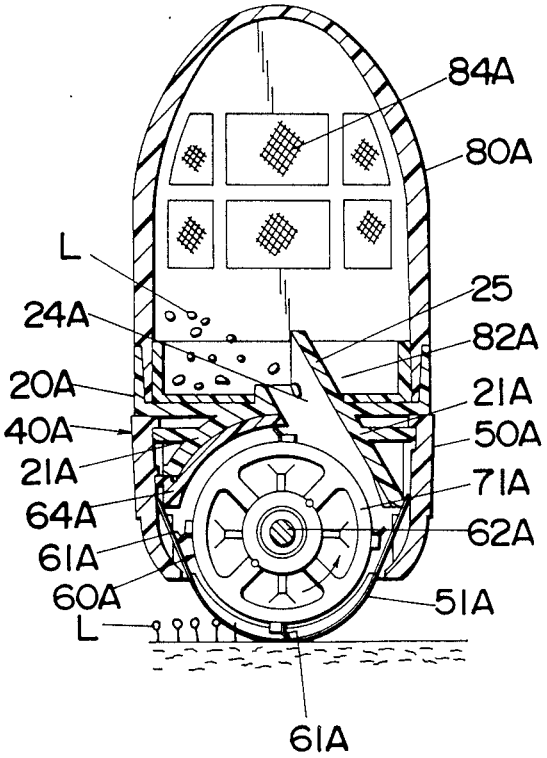
FIG. 17 is a sectional view of a clipper in accordance with a modification of the above embodiment.
Figure 18:
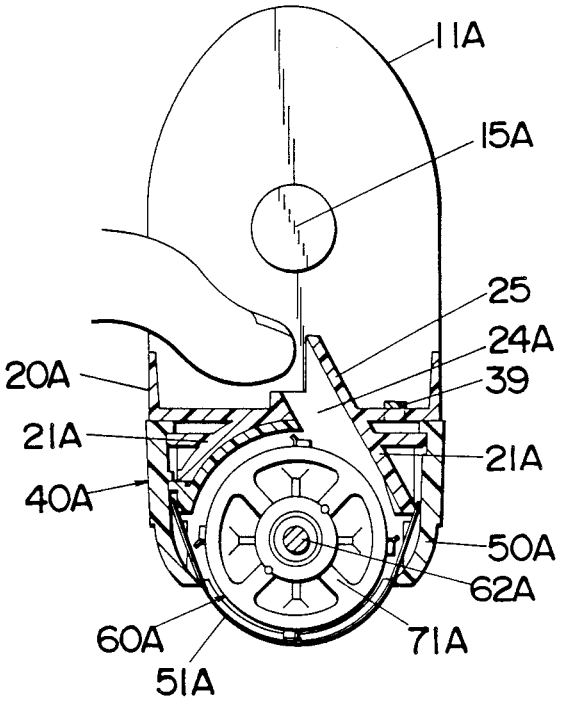
FIG. 18 is a sectional view of the clipper of FIG. 17 with a recovery chute removed therefrom.
Figure 19A:
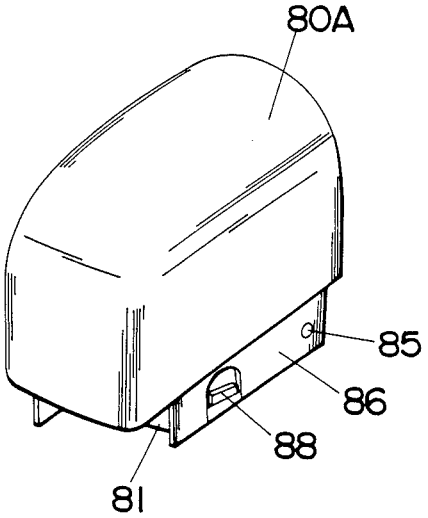
FIGS. 19A and 19B are perspective views respectively illustrating the recovery chute.
Figure 19B:
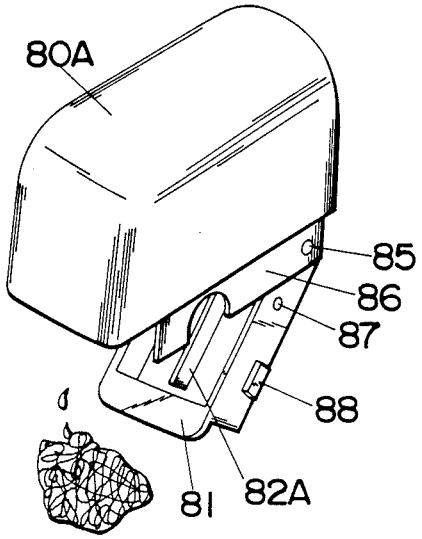

FIG. 17 illustrates a modification of the above embodiment which is generally similar in construction to the above embodiments. Therefore, like parts are designated by like numerals with the suffix letter of "A". In this modification, a mount base 20A is formed with an deflector 25 which extends from one lateral edge of a feed port 24A upwardly and inwardly into a chute 80A in such an inclined fashion to extend over the feed port 24A. The deflector 25 is advantageous for guiding the air flow carrying the clipped lints L and dust into the chute 80A and also for preventing access of finger to an inner cutter assembly 60A in a condition where the chute 80A is removed from the mount base 20A, as shown in FIG. 18. In this connection, the mount base 20A has a stop button 39 which is normally depressed by the chute 80A and is released when the chute 80A is removed so as to deenergize the motor and stop rotating the cutter assembly 40A and fan 32 for safe handling as well as for preventing the clipped lints from flowing outwardly out of the feed port 24A. Also in the modification, the chute 80A is designed to includes a bottom lid 81 with a collection port 82A, as shown in FIGS. 19A and 19B. The lid 81 is held by a pivot pin 85 and is clicked into a closed position of FIG. 19A by engaging click projections 87 (only one of which is seen in the figure) with corresponding dents (not seen) formed in the inner surfaces of side skirts 86. A lever 88 is formed on the sides of the lid 81 for opening thereof to dispose of the collected lints and dust, as shown in FIG. 19B. In the modification, the inner cutter assembly 60A is shown to have ring-shaped holder disks 71A between which the cutter blades 61A are held in parallel with the center drive shaft 62A and with the cutting edges projecting outwardly of the end holder disks 71A for shearing relation with the interior face of a shear foil 51A.

Figure 20:
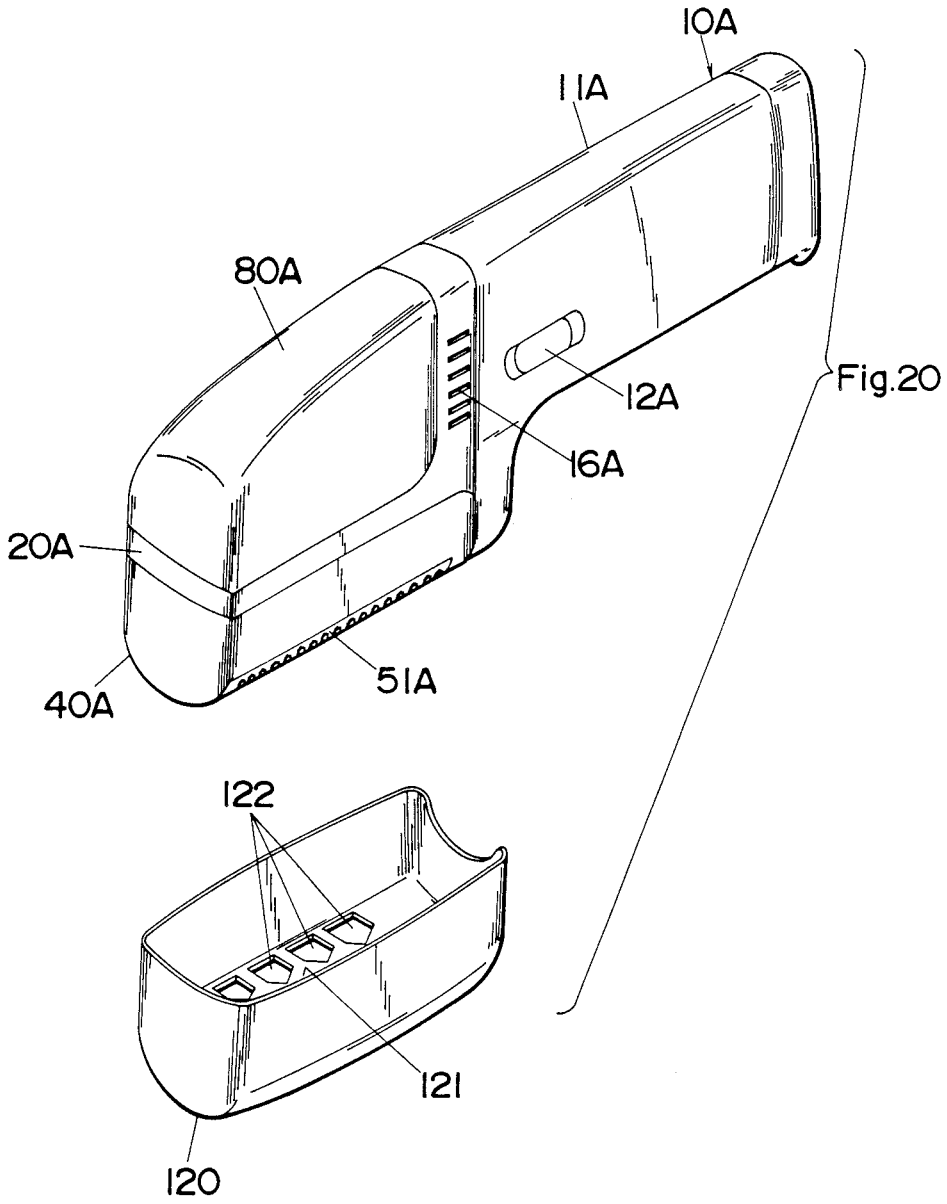
FIG. 20 is a perspective view of the clipper with an attachment cover.
Figure 21:
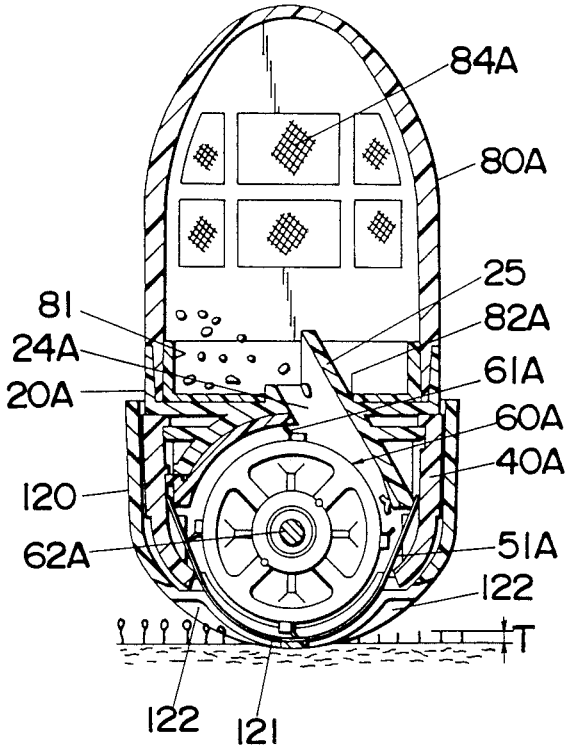
FIG. 21 is a sectional view of the clipper in a condition of moving across the fabric surface with the attachment cover in contact therewith.

As shown in FIG. 20, the cutting head 40A may be fitted with an attachment cover 120 of which bottom is laterally divided by center member 121 into two sections each having a plurality of access openings 122. The center member 121 acts as a spacer, as shown in FIG. 21, to keep the top end of the shear foil 51A away from the fabric surface by a distance T corresponding to the thickness of the center member 121, while the openings 122 allow the shear foil 51A to catch therethrough relatively tall lints or strands of fibers, thereby enabling to clip only the entangled heads of the fiber strands while preventing the fiber strands from being excessively clipped.

What is claimed is:

1. A hand-held clipper for removing entangled fibers from the surface of fabrics comprising:

a grip handle with a cutting head;

said cutting head comprising a shear foil having a number of perforations and a rotary cutter assembly having at least one cutter blade in shearing relation with the inner surface of said shear foil;

said shear foil being curved into a generally semicylindrical configuration to have a longitudinal axis and define a top portion and first and second side faces on opposite sides of said top portion;

said rotary cutter assembly having a rotation axis which is common to said longitudinal axis of said shear foil;

said blade having an elongated cutting edge extending in parallel to said rotation axis and being driven to rotate thereabout in one direction to move from said first side face to said second side face in continuous shearing engagement therewith for shearing the entangled strands of fibers entering the perforations in said shear foil; and said shear foil having the perforations larger at said first side face than at said second side face and at the top portion.

2. A hand-held clipper as set forth in claim 1, wherein said shear foil has the perforations larger at said second side face than at said top portion.

3. A hand-held clipper as set forth in claim 1, wherein said perforations of substantially same size are arranged in sloping rows angled with a straight line extending lengthwise in parallel with said longitudinal axis.

4. A hand-held clipper as set forth in claim 1, including a recovery chute, and a fan producing an air flow which draws in outside air through the perforations of said shear foil and flows through a feed port into said recovery chute carrying said clipped fiber strands in said air flow for collecting them into said recovery chute, said feed port arranged to be horizontally offset from a center plane including the common longitudinal axis of said cutter assembly and the top portion of said shear foil toward said second side face.

5. A hand-held clipper as set forth in claim 4, wherein said feed port is formed in a mount base which is provided at one end of said grip handle to detachably hold said cutting head and said recovery chute on the lower and upper surface thereof, respectively, said mount base being formed with a deflector which extends into said recovery chute in an overlying relation to said feed port.

6. A hand-held clipper for removing entangled fibers from the surface of fabrics comprising:

a grip handle with a mount base detachably holding a cutting head, said grip handle incorporating a drive source of rotation;

said cutting head comprising a shear foil having a number of perforations and a rotary cutter assembly having at least one cutter blade in shearing contact with the inner surface of said shear foil;

said shear foil being curved into a generally semicylindrical configuration to have a longitudinal axis and define a top portion and first and second side faces on opposite sides of said top portion;

said rotary cutter assembly having a drive shaft extending in coincidence with the longitudinal axis of said shear foil and carrying said cutter blade which has an elongated cutting edge extending in parallel to said drive shaft;

said drive shaft having its one end detachably connected to said drive source of rotation by means of a drive coupling provided at the grip handle adjacent to said mount base in order to rotate said cutter blade about the drive shaft in one direction to move from said first side face to said second side face in continuous shearing engagement therewith for shearing the entangled strands of fibers entering the perforations in said shear foil;

a cleaning head which is capable of replacing said cutter assembly and which comprises a cover frame detachable to said mount base and a brush received within said cover frame, said brush having a center drive shaft of which one end is detachably connectable to said drive coupling so that the brush is driven to rotate within said cover frame in one direction;

said cover frame provided in its bottom with a plurality of slits which extend in a direction generally perpendicular to said center drive shaft and spaced in the direction of said center drive shaft;

said brush comprising a plurality of bristles arranged along said center shaft to have their ends projecting outwardly through said slits for brushing a fabric surface across which the bottom of said cover frame is manipulated to move.

7. A hand-held clipper as set forth in claim 6, wherein said shear foil has the perforations larger at said first side face at said second side face and at the top portion.

8. A hand-held clipper as set forth in claim 7, wherein said shear foil has the perforations larger at said second side face than at the top portion.

9. A hand-held clipper as set forth in claim 6, including a recovery chute, and a fan producing an air flow which draws in outside air through the perforations of said shear foil when said cutting head is held on said mount base and which flows through a feed port into said recovery chute carrying said clipped fiber strands in said air flow for collecting them into said recovery chute;

said air flow drawing in outside air through the slit of said cover frame when said cleaning head is held on said mount base and flowing through said feed port into said recovery chute as carrying dusts or lints brushed away from the fabric surface on said air flow for collecting them into said recovery chute.

10. A hand-held clipper as set forth in claim 6 wherein said cleaning head and said cutting head are each detachably connectable to said mount base by means of a tongue and groove arrangement between the head and the mount base so that the head may be slid off the mount base, that sliding movement also engaging and disengaging said detachably connected drive shaft.

* * * * *